US005558505A

United States Patent [19]

Mordue et al.

[11] Patent Number: 5,558,505

[45] Date of Patent: Sep. 24, 1996

[54] MOLTEN METAL PUMP SUPPORT POST AND APPARATUS FOR REMOVING IT FROM A BASE

[75] Inventors: George S. Mordue, Ravenna; Richard S. Henderson, Solon; Ronald E. Gilbert, Chardon; David M. Masarin, Hinckley, all of Ohio

[73] Assignee: Metaullics Systems Co., L.P., Solon, Ohio

[21] Appl. No.: 287,914

[22] Filed: Aug. 9, 1994

[51] Int. Cl.[6] ..... F04B 35/00

[52] U.S. Cl. ..... 417/360; 266/239; 222/596

[58] Field of Search ..... 417/360; 266/236, 266/239; 222/591, 596; 415/200, 213.1; 403/266, 267, 268

[56] References Cited

U.S. PATENT DOCUMENTS 2,808,782 10/1957 Thompson et al. ..... 415/213.1
2,934,245 4/1960 Emeny ..... 417/360
5,188,478 2/1993 Bitsch et al. ..... 403/267
5,203,681 4/1993 Cooper .

*Primary Examiner*—Charles Freay
*Attorney, Agent, or Firm*—Fay, Sharpe, Beall, Fagan, Minnich & McKee

[57] ABSTRACT

A post for a molten metal pump having an end joined to a hole in a pump base. The post end includes a longitudinal bore opening at the end of the post and a port opening to the side of the post intersecting the bore. A plug is inserted into the bore above the level of the port yet leaving a portion of the upper bore open. Cement can be injected into the bore and out the ports. Thereafter, a second plug can be inserted into the bore to drive cement out. To remove the post, it is cut across its longitudinal axis to expose the open upper portion of the bore. The opening is a pilot hole to drill a longitudinal hole in the post. A device having two members connected by a rod are attached to the upper and lower surfaces of the remaining post, respectively and tightened to break the cement joint.

19 Claims, 7 Drawing Sheets

MOLTEN METAL PUMP SUPPORT POST AND APPARATUS FOR REMOVING IT FROM A BASE

BACKGROUND OF THE INVENTION

This invention relates to a molten metal pump support post and a complementary apparatus designed to rapidly and efficiently remove the post from a molten metal pump base. More particularly, this invention relates to a unique molten metal pump post design which facilitates installation and rapid removal with a unique tool which minimizes damage to the base.

The support post and removal tool of this invention are particularly well suited to facilitate the rebuilding of molten metal pumps.

DESCRIPTION OF THE PRIOR ART

In the course of processing molten metal, it often is necessary to transfer the molten metal from one vessel to another or to circulate the molten metal within a vessel. Molten metal pumps are commonly used for these purposes. The pumps can also be used for other purposes, such as to inject purifying gases into the molten metal being pumped. A variety of pumps as described are available from Metaullics Systems Co., L.P., 31935 Aurora Road, Solon, Ohio 44139.

In the case where metal is melted in a reverbatory furnace, the furnace is typically provided with an external well in which a pump is disposed. When it is desired to remove molten metal from the vessel, a so-called transfer pump is used. When it is desired to circulate molten metal within the vessel, a so-called circulation pump is used. When it is desired to modify the molten metal/alloy composition disposed within the vessel, a so-called gas injection pump is used.

In each of these pumps, a rotatable impeller is disposed within a cavity of a base member in the molten metal and, upon rotation of the impeller, the molten metal is pumped through an outlet as desired. The impeller itself is supported for rotation in the base member by means of a rotatable refractory shaft. A motor to rotate the shaft is supported above the molten metal connected with the base by means of several support posts which suspend the base member within the molten metal.

Graphite is a preferred material from which to construct molten metal pumps because of its low cost, relative inertness to corrosion and because of its thermal shock resistance. As an alternative to graphite, ceramic materials such as silicon carbide, sialon, silicon nitride and aluminum titanate can be used. Although graphite can be protected from high temperature oxidation and erosion by various sleeves, coatings and treatments, it nevertheless deteriorates with time. Furthermore, graphite is not overly strong and shafts, impellers, posts, etc. can be fractured if handled roughly or if a large torque load is imposed on the shaft, ex. caused by dross jamming the impeller. Accordingly, removal of a molten metal pump from its molten metal environment to rebuild is a standard maintenance operation. As indicated above, the posts become oxidized or damaged and require replacement. Typically, a post is secured to the motor support by clamps. However, in the molten metal, posts have typically been secured to a base by mating the post with a hole in the base and bonding the two together with a refractory cement/adhesive. Typically, the refractory cement/adhesive is applied by hand to the hole and post.

Accordingly, once assembled, a significant effort is required to remove the post from the base and redefine the post hole in the base when rebuilding the pump. Moreover, the post and refractory cement must be removed by sawing, chipping, and/or drilling, usually in an attempt to effect an internal collapse of the post. This process is dirty, tedious and time consuming. In addition, these techniques are sometimes very destructive, resulting in damage to the base itself. In fact, occasionally an entire section of the base is accidentally broken away rendering the unit essentially unusable.

Accordingly, given the general necessity to replace a pump post every six to eight months, the prior art requirement of four to six hours to remove and replace the three (most common design) old posts, and the likelihood of damaging the base, it would be very desirable in this art to have a method of rapidly and unintrusively removing a post.

SUMMARY OF THE INVENTION

Accordingly, it is a primary object of this invention to provide a new and improved molten metal pump post and apparatus for removing it from a base.

It is a further object of this invention to provide a new and improved post which allows an improved method of attaching of the post to the base by controlling the refractory cement application which in turn facilitates the use of a post removal tool.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects in accordance with the purpose of the invention as embodied and broadly described herein, the molten metal pump post of the invention comprises an elongated, preferably cylindrical body of a refractory material having opposite ends. A first end is secured to the motor support apparatus. The opposite end, secured to the pump base, includes a generally longitudinal, preferably axial bore extending from an opening in the end. Preferably, the bore has a depth sufficient to extend beyond the region interfacing with the molten metal pump base in its assembled form. At least one and preferably two opposed ports intersect the bore and extend to the exterior side of the post. The ports intersect an intermediate point of the bore in a region which permits adhesive/cement discharge at the side of the post interfacing with the wall of the hole of the pump base.

Preferably, the bore has at least two diameters, a first extending from the opening in the end to above the highest port, having a distance "x" between the highest port and the beginning of a second narrower diameter. In the assembly of the post and base, a plug, preferably of graphite, having a length of about "x" is inserted into the bore in the area above where the port intersects with the bore. The plug is sized to fit within the first diameter of the bore to prevent adhesive/cement passage. The plug is inserted into the bore, generally to the point where the bore diameter narrows. Accordingly, in its inserted position, the plug is above the ports, yet below the second narrower diameter section of the bore, leaving an open essentially hollow cavity in the post. Thereafter, refractory cement/adhesive can be injected into the bore opening, up the bore and through the port outlets. As it exists the ports, the adhesive/cement spreads across the interface of the post side and walls of the hole in the base. Prior to hardening of the adhesive/cement, a second appropriately sized plug is driven into the bore to the level of the first plug, driving out the adhesive remaining in the bore. After setting of the adhesive, a usable post and base assembly exists.

When removal of the post from the base is required, a saw is used to cut the post, preferably perpendicular to the longitudinal axis of the post, at a position above the top of the base. Preferably, the cut is made at a position which will intersect the second narrower diameter portion of the bore forming a cavity. Accordingly, a pilot hole is exposed in the post section which interfaces with the base. The pilot hole acts as a guide for drilling through the graphite plugs inserted into the bore to reestablish a longitudinal hole in the post. Thereafter, the post pulling assembly is positioned to remove the remainder of the post. The post pulling assembly and post design of this invention have been found to allow complete replacement of three old posts in less than one and one-half hours.

The post pulling assembly comprises a first cup-like member positioned over the sawed off end of the post. The cup-like member is preferably slightly larger in diameter than the post and is at least slightly deeper than the remaining post height, i.e. that portion from the cut line to the top surface of the base, resulting in interface of the rim of the open end of the cup-like member with the top surface of the base. Thereafter, a rod is inserted into a hole in the closed end of the cup-like member and through the hole drilled in the post. One end of the rod is secured to the cup-like member while the remaining end extends the length of the bore protruding from the opposite end. A second member having a hole sized to accommodate the rod is placed over the rod and over the exposed bottom end of the post. A nut or other mechanism for tightening the two members together is then threaded on the rod. Tightening the nut forces the members together, the second member being sized equally with the diameter of the post or slightly smaller than the post. Accordingly, tightening the members drives the post upward from the base toward the cup-like member breaking the refractory adhesive/cement joint between the post and the base, quickly, cleanly, and effectively removing the post without damage to the base. In certain instances, it may be desirable to hit the post pulling assembly with a mallet to assist the breaking of the adhesive bonds.

BRIEF DESCRIPTION OF THE DRAWINGS

The invention consists of the novel parts, construction, arrangements, combinations and improvements shown and described. The accompanying drawings, which are incorporated in and constitute a part of the specification, illustrate one embodiment of the invention and, together with the description, serve to explain the principles of the invention.

Of the drawings.

DETAILED DESCRIPTION OF THE INVENTION

Reference will now be made in detail to the present preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
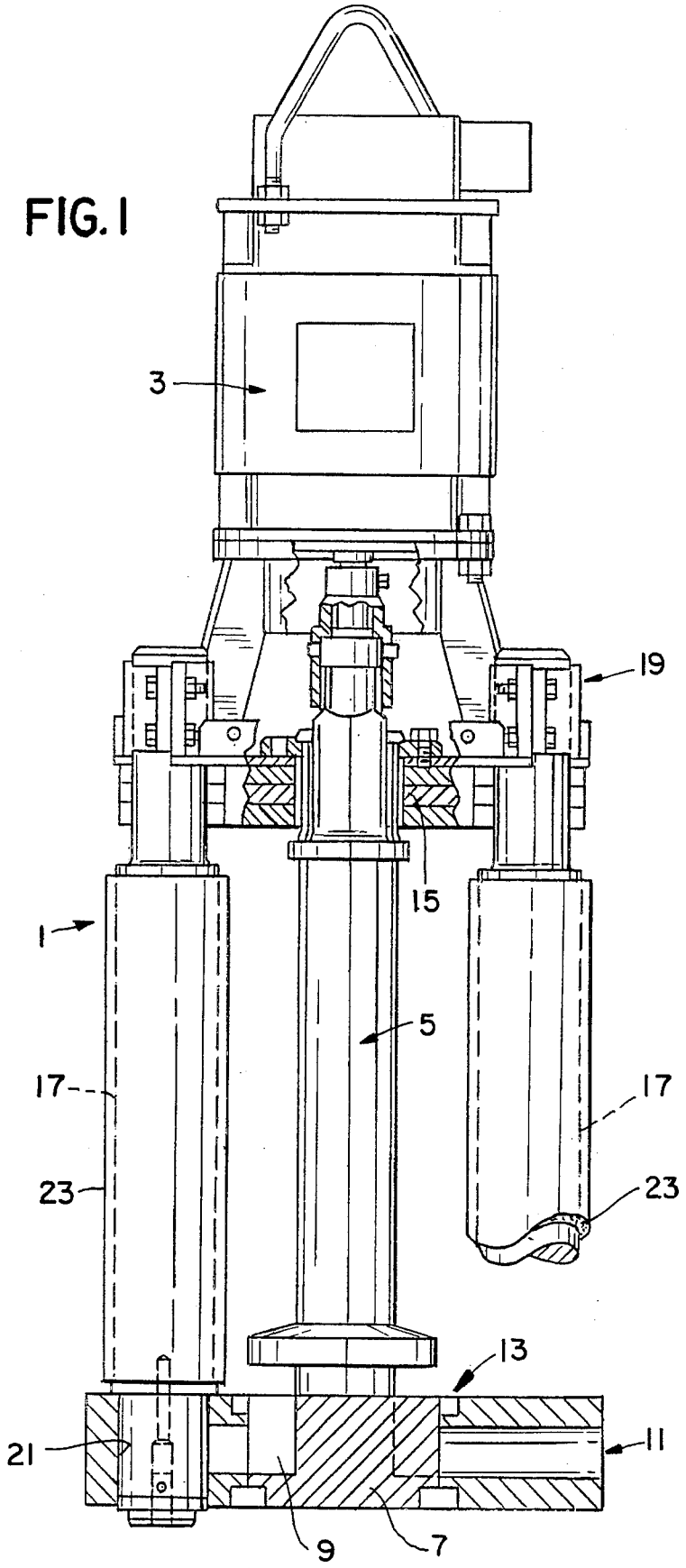
FIG. 1 is an elevational view, partially in cross-section, of a molten metal pump of the present invention.

Referring now to FIG. 1, a molten metal pump in which the post of the current invention can be utilized is demonstrated. Molten metal pump 1 includes a motor 3 driving a shaft 5 which in turn rotates impeller 7 housed in the pumping chamber 9 of base 13. Rotation of the impeller when the pump is in a molten metal bath drives molten metal through outlet 11. Motor 3 is supported by platform 15 and connected by posts 17 to base 13. Posts 17 are secured by a clamp mechanism 19 to the platform 15 and to base 13 in holes 21. Typically, the post is cemented with a refractory adhesive/cement such as Frakset Cement, available from Metaullics Systems Co., L.P., 31935 Aurora Road, Solon, Ohio 44139, into the holes. In a preferred embodiment the posts 17 are sheathed with a refractory material 23 comprised of silicon carbide.

Figure 2:
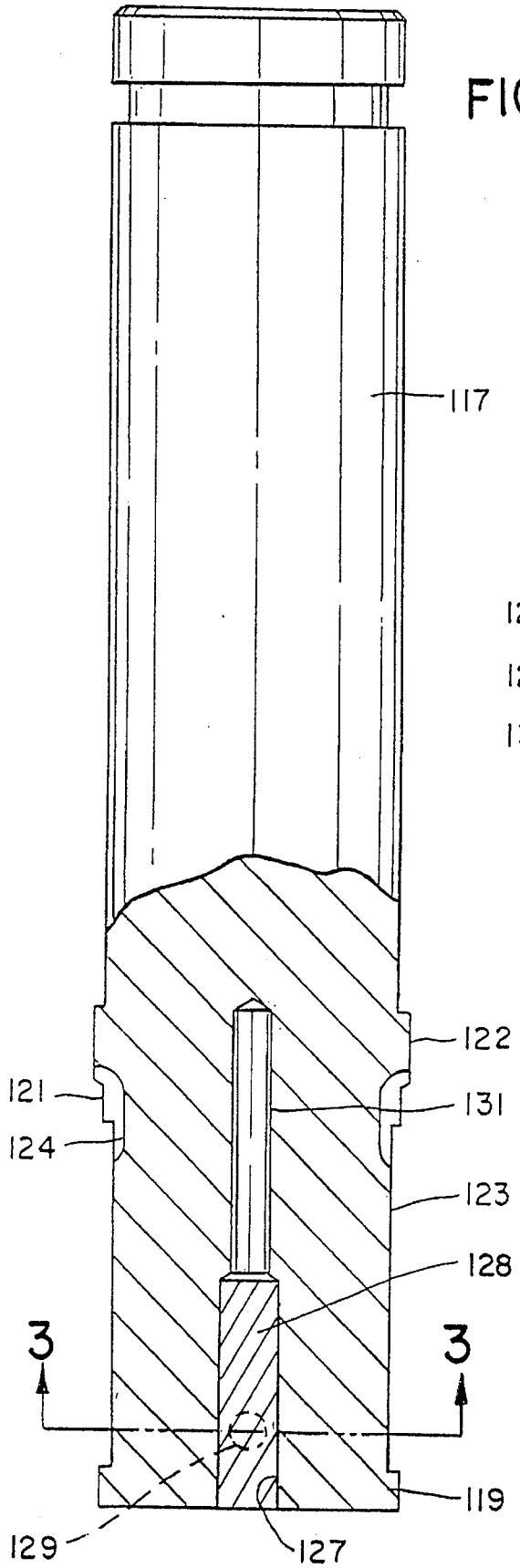
FIG. 2 is a partial cross-section view of a post in accord with the present invention.
Figure 3:
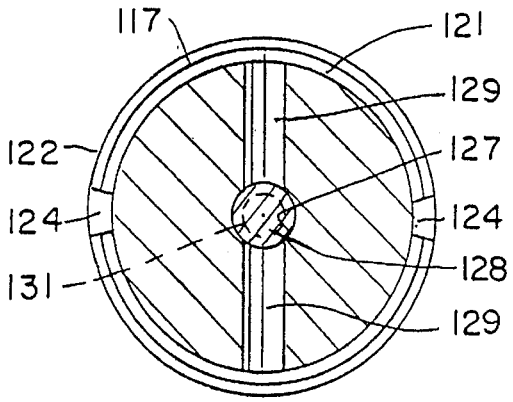
FIG. 3 is a cross-section view taken along line 3—3 of FIG. 2.

Referring now to FIGS. 2 and 3, a preferred post design can be seen. Post 117 is shown having a bottom enlarged diameter shoulder 119, a top enlarged diameter shoulder 121 and an intermediate side wall section 123 which interfaces with the hole of a base. Preferably, shoulders 119 and 121 are sized to mate closely with the hole in the base and prevent refractory cement/adhesive from escaping the side wall section 123. A shoulder having a diameter 122 larger than the diameter of the hole facilitates positioning the post.

A bore having a lower, larger diameter portion 127 and an upper, narrower diameter portion 131, extends along a portion of the longitudinal axis of post 117. An adhesive/cement access port 129 resides in the lower portion 127. As best seen in FIG. 3, weepholes 124 are positioned at ninety degree angles to ports 129 to facilitate spreading of the adhesive. Weepholes 124 are preferably open at the top of side wall section 123, adjacent rim 122 to facilitate seepage of excess adhesive/cement and to determine when sufficient adhesive has been injected. Injection of adhesive can be made into bore 127 by any means known to those of ordinary skill in the art, for example, a caulking gun.

Figure 4:
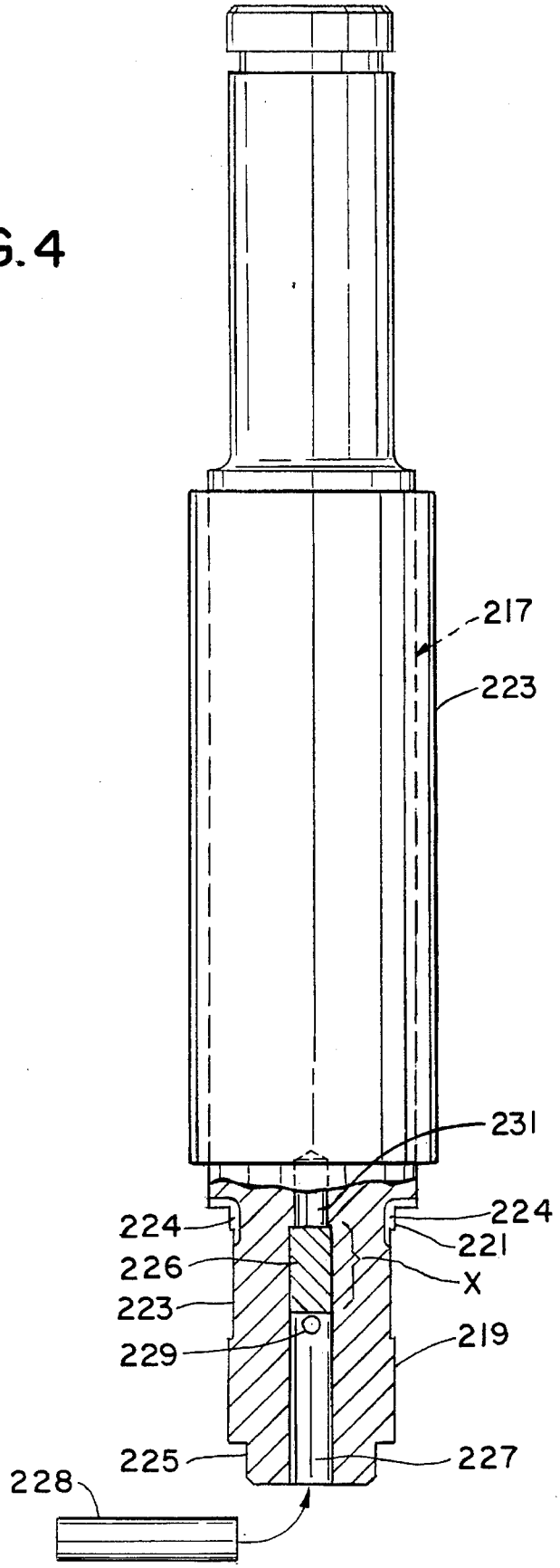
FIG. 4 is an elevational view, partially in cross-section, of an alternative post in accord with the present invention.

FIG. 4 demonstrates an alternative embodiment of the invention wherein post 217 is surrounded by a protective sheath 223. In contrast to the post of FIG. 2, the alternative post in FIG. 4 includes a foot 225. The foot 225 extends the post beyond the bottom of the base providing integral support for the pump. In this embodiment, the post diameter 217 is greater than the diameter of the hole in the base, however, top rim 221 and lower rim 219 are sized to create a boundary region for adhesive/cement injection. Weepholes 224 are shown at ninety degree angles to the port 229. Again, the longitudinal bore has a lower, larger diameter portion 227 and an upper, narrower diameter portion 231.

In this embodiment, a plug 226 is inserted into the bore 227 slightly above port level 229. The plug extends a distance "x" from just above port 229 to the narrower diameter portion 231 of the bore. During its construction post 217 is inserted into the hole of a base. Thereafter, a refractory adhesive/cement is injected into bore 227 at a sufficient pressure to force it out ports 229, coating the refractory cement/adhesive on side wall 223 and coincidentally the wall of the hole in the base. Refractory adhesive/cement is injected until a steady flow is seen exiting weepholes 224, indicating that a consistent coating has been achieved. Thereafter, a second plug 228 (FIG. 5, item 328) is inserted into bore 227 to drive the remaining adhesive therein out port 229. Preferably, the plug 228 inserted into bore 227 is the same length as the remaining portion of bore 227.

Figure 5:
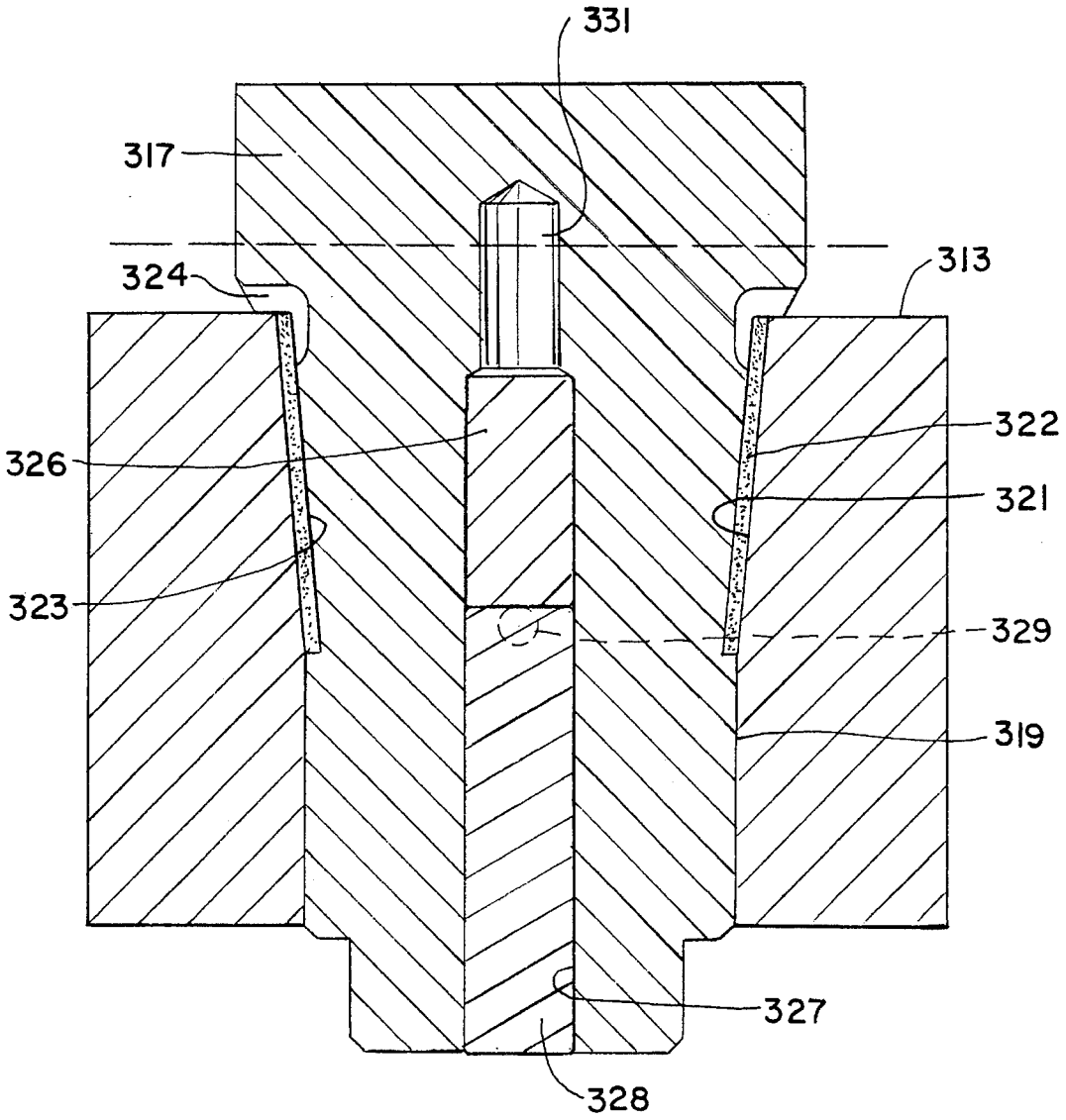
FIG. 5 is an exploded cross-sectional view of an alternative post design in relationship to the base in accord with the present invention.

The constructed form of an assembled alternative post design can best be seen in FIG. 5 wherein base 313 includes a hole 321 sized to accommodate a post 317. In this instance, the post and the hole include substantially matching tapers. Post 317 includes a lower rim 319 sized generally coincidentally with the diameter of the hole 321. Post 317 includes recessed area 323 which creates a gap between post side wall and the wall of the hole in the bore. This gap is filled by refractory cement 323. Lower bore 327 and upper bore 331 are axially aligned along the longitudinal axis of the post 317. Upper smaller diameter portion 331 of the bore is an open cavity bounded by plug 326. Lower plug 328 blocks the lower portion of bore 327. When removing the post, the post is cut across its longitudinal axis at a point which will expose upper bore section 331, which then acts as a pilot hole to drill a longitudinal hole the length of the remaining post.

Figure 6:
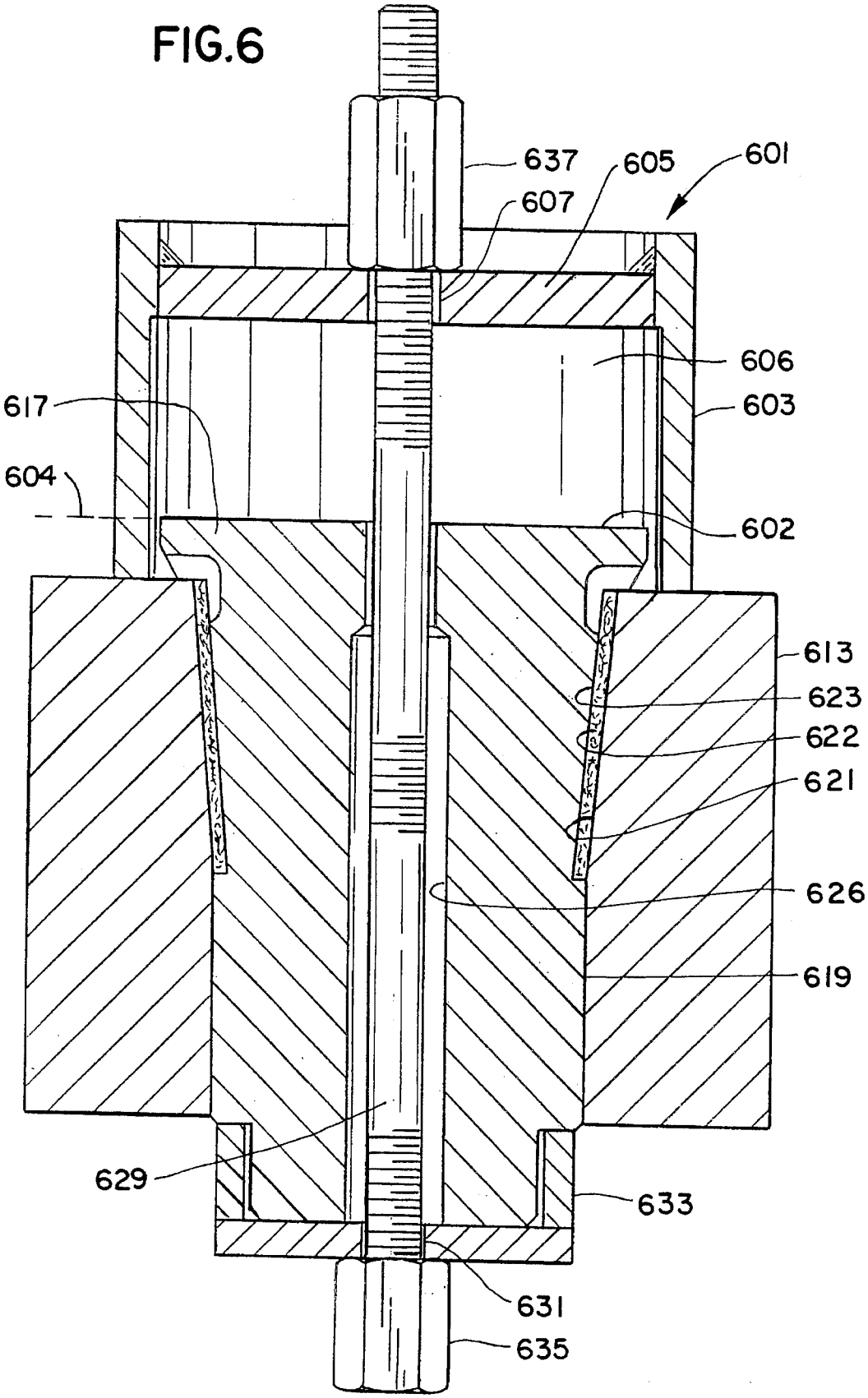
FIG. 6 is a cross-sectional view of the post of FIG. 5 having the post pulling tool in place in accord with the present invention.

Referring now to FIG. 6, the post pulling tool 601 in place on a post 619 being removed from a base 613 can be seen. This illustration depicts the post 619 after being cut above the top surface 602 of the base 613. Cut line 604 leaves an upper post section 617. Upper cup-like member 603 is placed over upper post section 617 leaving a gap 606 between the cut line 604 and the end plate 605 of cup-like member 603. A rod 629 extends through a hole 607 in cup-like member 603, through the drill hole 626 through a hole 631 in base member 633 and is attached thereto by end nut 635. The other end of the rod is secured to cup-like member 603 with through nut 637 which can be tightened. Tightening of nut 637 draws cup-like members 603 and 633 together, breaking the refractory cement 622 holding base hole wall 621 and post side wall 623 together.

Figure 7:
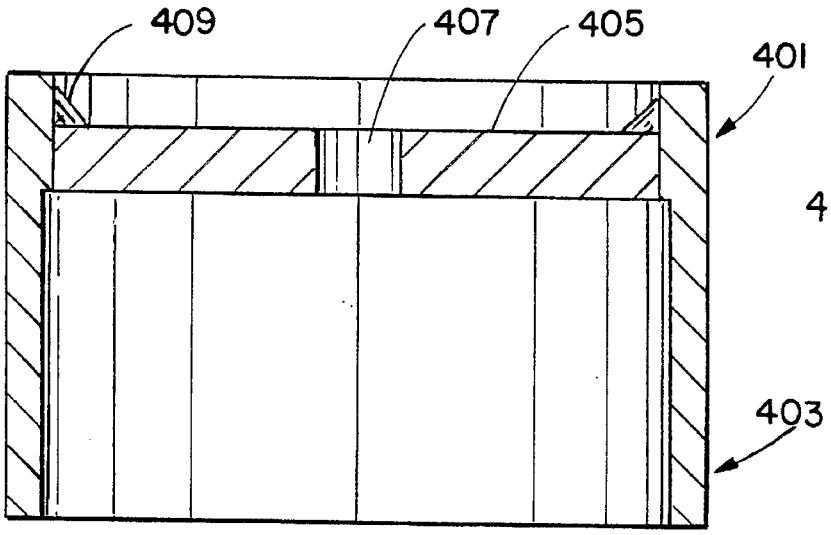
FIG. 7 is a cross-sectional view of the cup-like top portion of the post pulling tool in accord with the present invention.
Figure 8:
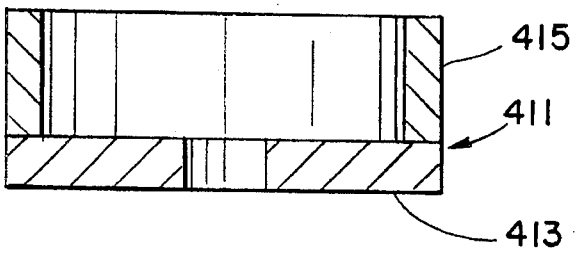
FIG. 8 is a cross-sectional view of the bottom end of the post pulling tool in accord with the present invention.
Figure 9:
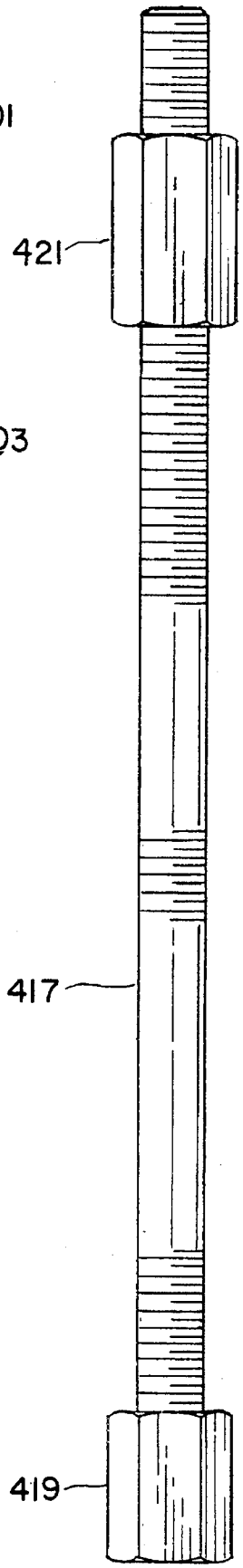
FIG. 9 is a cross-sectional view of the rod in accord with the post pulling tool of the present invention.

Referring now to FIGS. 7, 8 and 9, the post pulling tool is illustrated. FIG. 7 shows the cup-like member 401 which is placed over the upper cut away region of a molten metal pump post. Cup-like member 401 is comprised of side walls 403, preferably of the same general shape of the post, which is typically round. An end wall 405 having a hole 407 is then preferably welded (see weld positions 409 at a terminal end of the cup-like member 401. FIG. 8 demonstrates the lower member 411 comprised of an end plate having a hole 413 and side wall 415 again, generally forming to the shape of the base of the post. In this embodiment, side walls 415 are present on a member intended to be utilized with a post having a foot as shown in FIG. 5. However, in other embodiments in which a post does not include a foot or even when a foot is present, the only necessary element is a plate-like member 413 having a hole size approximately equal to or less than the size of the base of the post diameter. FIG. 9 shows a threaded rod 417 utilized to connect members 401 and 411. In this embodiment, rod 417 is shown having a first end nut 419 and a second adjustable nut 421. However, the rod could be welded or otherwise attached to one of the members. The only requirement being that a free end of the rod be available to pass through the post drilled hole and a hole in the opposite member, and include a mechanism for tightening the two members together.

Figure 10:
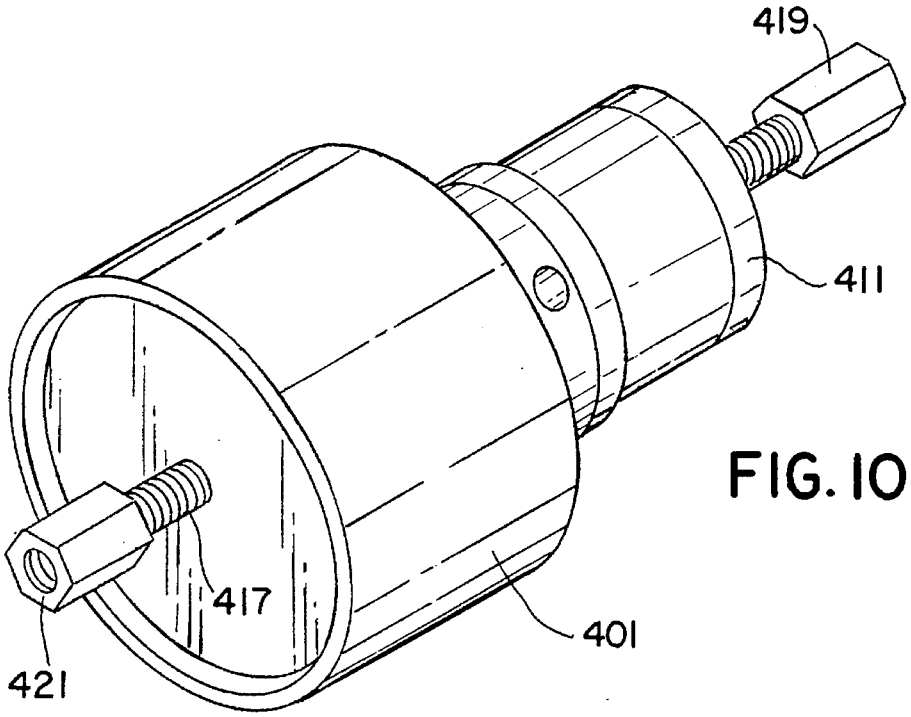
FIG. 10 is a perspective view of the post pulling tool of the present invention.

FIG. 10 is a perspective view of the post pulling tool showing top cup-like member 401, lower member 411, rod 417, end nut 419 and adjustable nut 421.

Figure 11:
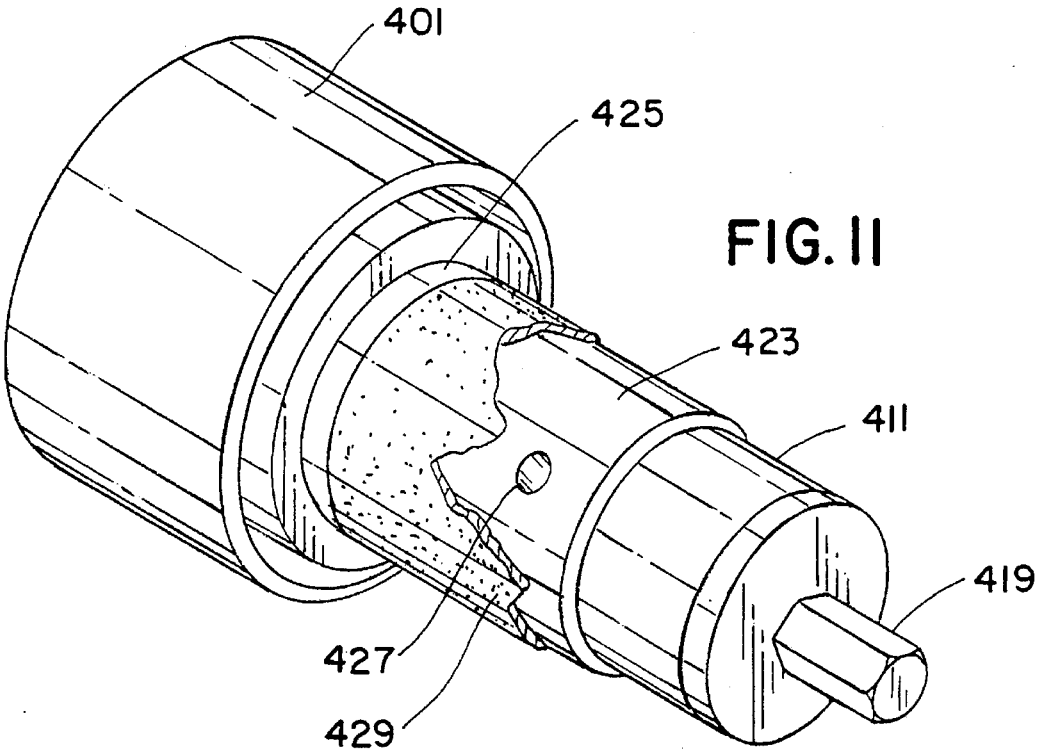
FIG. 11 is a perspective view of the post pulling tool of the present invention after removal of a post.

FIG. 11 shows the perspective view of the post pulling tool after removal of a post. Again, cup-like member 401 is interconnected with lower member 411 by means of a rod, only the end 419 of which is visible. In this embodiment, the side wall of a post 423, the main body of the post 425, a port 427 are visible. Remnants of refractory cement 429 are also visible.

Thus, it is apparent that there has been provided, in accordance with the invention, a molten metal post and an apparatus for its removal that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

Having thus described the invention, it is claimed:

1. An apparatus for removing a molten metal pump post comprising a cup-like member sized to fit over a section of a molten metal pump post and a base member, a rod mating said cup-like member with said base member wherein at least one of a first or second end of said rod is coupled with at least one of said members in a manner which allows urging said members together.

2. The apparatus of claim 1 wherein said base member is cup-like.

3. The apparatus of claim 1 wherein said rod is at least partially threaded and coupled to said member with a nut.

4. The apparatus of claim 1 wherein said rod is at least partially threaded and attached to said member with a nut.

5. The apparatus of claim 1 wherein said rod is attached to said member with a weld.

6. The apparatus of claim 1 wherein both said base member and said cup-like member are generally cylindrical, each having one open en and one closed end.

7. The apparatus of claim 1 wherein said base member has a dimension on an axis perpendicular to said rod which is less than a cross-section of said post taken along a longitudinal axis of said post.

8. The apparatus of claim 1 wherein at least one of said cup-like member and said base member includes a hole through which at least one end of said rod extends, said at least one end of said rod being threaded and including a nut attached to said threaded end which allows the members to be drawn together.

9. A molten metal pump post comprising an elongated body of a refractory material having opposite ends, a first end having a generally longitudinal bore opening at said first end, at least one tangential port intersecting said longitudinal bore and opening at a side of said elongated body, said bore including a section extending a distance beyond said point of intersection with said port, said bore and port sized to accommodate passage of adhesive from said opening in said first end to said side of said post.

10. The post of claim 8 wherein a portion of said bore extends longitudinally toward said second end of said post a distance beyond the point of intersection with said at least one port.

11. The post of claim 8 having a cylindrical shape.

12. The post of claim 8 comprised of graphite.

13. The post of claim 10, wherein said section of said bore extending a distance beyond said point of intersection with said port has a reduced diameter.

14. The post of claim 8 wherein said bore is generally axially aligned with said post.

15. The post of claim 8 wherein two ports intersect with said bore.

16. The post of claim 8 comprised of a ceramic material.

17. A method of removing a post adhesively secured to the base of a molten metal pump, said base having at least one hole which mates with a bottom portion of said post, the method comprising cutting said post perpendicular to its longitudinal axis to expose a pilot hole in said bottom portion, using said pilot hole to drill a bore through said bottom portion of said post, inserting a rod through said bore, placing a first member over said post, said member overlapping said post and contacting a surface of said base, placing a second member over an opposite end of said post, said second member sized smaller than said hole in said base, the rod passing through each member, securing said members to the rod, and urging said members together to break said adhesive and remove said post from said hole.

18. A molten metal pump post comprising an elongated body of a refractory material having opposite ends, a first end having a generally longitudinal bore opening at said first end and a plug sized to mate with said bore, at least one tangential port intersecting said longitudinal bore and opening at a side of said elongated body, said bore and port sized to accommodate passage of adhesive from said opening in said first end to said side of said post.

19. A method of removing a post adhesively secured to the base of a molten metal pump, said base having at least one hole which mates with a bottom portion of said post, the method comprising cutting said post perpendicular to its longitudinal axis, drilling a bore through said bottom portion of said post, inserting a rod through said bore, placing a first member over said post, said member overlapping said post and contacting a surface of said base, placing a second member over an opposite end of said post, securing said members to the rod, and urging said members together to break said adhesive and remove said post from said hole.

* * * * *